United States Patent [19]

Jordan

[11] 4,146,068

[45] Mar. 27, 1979

[54] PIPELESS FILLING UNIT FOR COUNTERPRESSURE BOTTLING MACHINES

[75] Inventor: Heinrich Jordan, Dortmund, Fed. Rep. of Germany

[73] Assignee: Holstein & Kappert GmbH, Dortmund, Fed. Rep. of Germany

[21] Appl. No.: 913,865

[22] Filed: Jun. 8, 1978

[30] Foreign Application Priority Data

Jun. 21, 1977 [DE] Fed. Rep. of Germany ..... 2727723

[51] Int. Cl.[2] ..... B65B 31/04; B67C 3/12

[52] U.S. Cl. ..... 141/39; 141/286

[58] Field of Search ..... 141/1, 4–8, 141/37, 39, 40, 49, 52–54, 57, 58, 63, 64, 192, 197, 198, 227, 302, 303, 286, 392

[56] References Cited

U.S. PATENT DOCUMENTS 3,604,480 9/1971 Reichert et al. ..... 141/39

*Primary Examiner*—Houston S. Bell, Jr.

*Attorney, Agent, or Firm*—Michael J. Striker

[57] ABSTRACT

The pipeless filling unit for counterpressure bottling machines includes a siphon closure consisting of a bell-shaped stopper projecting with its rim portion into an annular groove. The bell-shaped stopper is fixedly held in position in the liquid discharging channel and has a central boring for guiding an axially displaceable valve tube; the bell-shaped rim portion of the stopper is provided around the whole circumference with a plurality of vertically and radially directed slits for intercepting and rinsing away particles from the discharged liquid.

5 Claims, 2 Drawing Figures

PIPELESS FILLING UNIT FOR COUNTERPRESSURE BOTTLING MACHINES

BACKGROUND OF THE INVENTION

This invention relates generally to counterpressure bottling machines and more specifically it relates to a filling unit for use in such machines, the unit being of the type having no filling pipe and having a siphon closure arranged at the level of the valve seat in the liquid discharging channel, the siphon closure comprising a ring-shaped groove for sealing liquid and a bell-shaped stopper projecting with its rim portion into the groove.

Filling units of this type are used chiefly for charging $CO_2$—containing liquids that are discharged from a pressure tank of the bottling machine through the filling unit into a bottle connected to the latter. Prior to the initiation of the actual filling process, the pressure between the bottle and the pressure tank is equalized so that the liquid is discharged into the bottle by the force of gravity. During the filling process the counterpressure gas taking place in the bottle is exchanged for the discharged liquid and returned into the gas space in the tank. For this purpose a gas-return pipe is used whereby the position of its opening in the bottle determines the level of the charge and limits the rate of the filling process as soon as the liquid reaches the outlet opening and the exchange of the gas from the bottle back into the liquid tank is no longer possible. In known filling units of this type the danger exists that an amount of gas taking place above the liquid level might bubble up through the still open liquid discharging channel and cause a supplemental discharge of the liquid retained above the valve seat in the liquid discharging channel. In order to avoid this shortcoming, it has been devised to make the valve for the liquid in the form of a siphon by providing the valve plunger with a bell-shaped stopper the downwardly projecting bell-like rim portion of which is immersed into sealing liquid retained in a siphon channel. Apart from a minor decrease in efficiency of the filling system, this siphon-like embodiment has the disadvantage that both the annular groove forming the siphon channel and the bell-shaped stopper have to be made relatively long to be deeply covered by the liquid. The reason for this extended structure is that the bell-shaped stopper always moves together with the plunger of the liquid discharging valve between the closing and opening position of the latter. Due to the fact that the siphoning effect is needed mainly in the open position of the valve, the bell-shaped stopper has to be so long that also in this open position it is sufficiently immersed in the sealing liquid in the siphon groove. Another disadvantage of this known embodiment results also from the fact that due to the different depth of immerging of the bell-shaped stopper according to the difference in opening position of the valve, there result variations in the cross-section of the liquid discharging passage and these variations in turn case different levels of charge in the bottle. In addition, the continuously changing position of the stopper and the resulting continuous change of boundary layers of the liquid prevent constructional measures that in view of surface tension of the discharged liquid would be desirable for increasing the cross-section of the liquid discharging passage.

SUMMARY OF THE INVENTION

An object of this invention is therefore to overcome the disadvantages of prior art filling units of the above-described type.

More particularly, an object of this invention is to provide an improved filling unit having siphon closure means that have minimum height.

Another object of this invention is to provide a siphon closure that serves also for guiding a centrally arranged and axially reciprocable valve tube of the gas return conduit without effecting the depth of immersion of the bell-shaped stopper and without disturbing the filling process.

Still another object of this invention is to avoid turbulences in the discharged liquid resulting from sealing liquid present in the siphon groove or channel.

Still another object of this invention is to insure maximum cross-sectional area of the liquid discharging passage.

In keeping with these objects, and others which will become apparent hereafter, one feature of the invention resides, in a filling unit operating without filling pipe in the bottling machine of the above-described type, in a combination which comprises a stationary bell-shaped stopper that is secured in position in the liquid discharging passage by means of radial projections or supporting arms, the bell-shaped stopper having a central boring for guiding the axially movable valve tube and means for securing the valve tube against rotation about its axis and the lower bell-shaped portion of the stopper at least in the range of immersion in the sealing liquid in the siphon groove being provided with vertically and radially directed slits. The outer surface in the lower range of the bell-shaped stopper portion has a substantially cylindrical shape that, above the siphon groove in the range of the valve seat of the liquid discharging passage, gradually tapers upwardly. The central boring of the stopper is cylindrical to guide slidably the axially reciprocable valve tube; an axial groove in the boring guides a corresponding key or projection in the valve tube to prevent rotation of the valve tube about its axis.

It is advantageous when the lower part of the bell-shaped stopper has an increased inner diameter to form a stop surface for the sealing disc of the valve tube.

Due to the immobile arrangement of the bell-shaped stopper and because of the fact that the stopper is kept immersed in the siphon groove at constant depth, the height of the stopper can be substantially reduced. Consequently, the aforementioned disadvantages of prior art movable stoppers resulting from continuously changing conditions of the discharge, are avoided. At the same time, the weight of the valve tube is due to the reduced size of the stopper considerably reduced and the biasing spring lifting the valve tube in axial direction can operate with a smaller biasing force which in turn brings the advantage that sensitive starting and closing action of the valve is achieved. In addition, in the arrangement of the bell-shaped stopper according to this invention it is possible to provide an increased cross-section of the discharge passage without permitting the escape of the gas that otherwise would result due to the interface changes in the flow of the liquid caused by the upward and downward movement of the valve tube or piston.

The novel features which are considered as characteristic for the invention are set forth in particular in the appended claims. The invention itself, however, both as to its construction and its method of operation, together with additional objects and advantages thereof, will be best understood from the following description of specific embodiments when read in connection with the accompanying drawings.

Figures 1, 2:
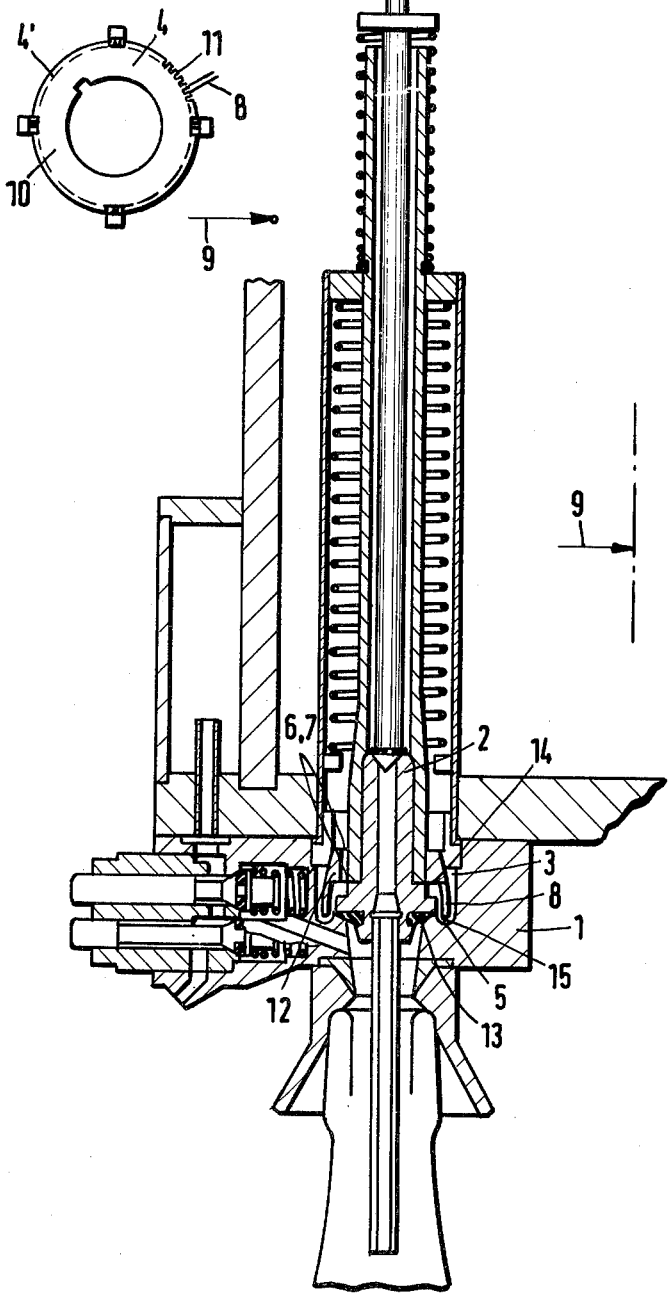
FIG. 1 is a sectional side view of the filling unit of this invention.
FIG. 2 is a top view of the bell-shaped stopper in the siphon closure in the device of FIG. 1.

DESCRIPTION OF THE PREFERRED EMBODIMENTS:

The filling unit illustrated in connection with a liquid tank of a bottling machine rotatable about axis 9 includes a valve body 1 connected to the bottom of the liquid tank and communicating with the interior of the tank through a liquid discharging tube. The central passage of the valve body 1 is shaped to form a valve seat 13 for cooperating with the piston disc of axially movable valve tube 2. The valve tube 2 is guided for reciprocal movement in fixedly mounted bell-shaped stopper 4 that together with an annular groove 3 provided in the valve body 1 forms a siphon closure for the liquid being discharged through the liquid discharging channel into a bottle. The bell-shaped stopper 4 is secured in position in the liquid discharging passage in the valve body 1 by means of radially projecting supporting arms; the center boring of the stopper serves, as mentioned above, for guiding the tubular piston or valve tube 2 of the liquid discharging valve whereby the central passage of the tube 2 acts as a gas return conduit. By this arrangement the guides that in prior art filling units of this type were necessary for stabilizing the valve tube 2 and cause reduction of the cross-sectional area of the liquid passage, can be dispensed with. The bell-shaped stopper 4 has only a recessed keyway 6 provided in the wall of its central boring for guiding a corresponding projection 7 in the valve tube 2 that prevents the valve tube from rotation.

According to this invention, the bell-shaped stopper 4 has on its lower part a plurality of vertically and radially directed slits 8 formed throughout the lower wall 4' so that the lower part of the stopper has a comb-like configuration. This arrangement allows pulp fibers that during the liquid discharge deposit on the surface of the upper part of the stopper to be rinsed down into the slits 8 and therefrom rinsed away. The width of the slits 8 is preferably in the range of 0.4 to 0.8 millimeters, and the same range of sizes have the teeth or prongs between the slits. The number and/or the width of the slits 8 on the periphery of the stopper 4 can vary according to the type of the bottling machine used and can be larger on the adverse side 10 relative to the axis of rotation 9 than on the side 11 facing the axis of rotation. In this manner it is possible to increase the efficiency of the filling unit by amplifying the streaming of the liquid by force components resulting due to the rotation of the bottling machine.

The outer surface 12 of the stopper 4 as mentioned above, has a bell-like shape which at the lower part of the stopper approximately at the level of the valve seat 13 is substantially cylindrical and the upper part of which tapers upwardly. The central boring in the upper part of the stopper serves for guiding the valve tube 2 and has an axial guiding groove 6 for receiving a guiding projection 7 on the valve tube 2. The axial boring on the lower part of the stopper is increased in diameter to form a stop face or surface 14 for limiting the maximum stroke of the piston disc of the reciprocal valve tube 2. The lower part of the stopper that is provided with the comb-like slits projections about 1 to 1½ millimeter into the annular groove 15 of the siphon closure and does not change this position so that exactly definable flow conditions of the liquid are maintained.

It will be understood that each of the elements described above, or two or more together, may also find a useful application in other types of constructions differing from the types described above.

While the invention has been illustrated and described as embodied in a filling unit for rotary bottling machines, it is not intended to be limited to the details shown, since various modifications and structural changes may be made without departing in any way from the spirit of the present invention.

What is claimed as new and desired to be protected by Letters Patent is set forth in the appended claims.

1. In a counterpressure bottling machine having a liquid tank, a filling unit comprising a liquid discharging channel projecting into said tank; a valve body connected to said tank and communicating with said liquid discharging channel; a valve tube arranged for reciprocating axial movement in said liquid discharging channel and forming with a valve seat in said valve body a liquid discharging valve; a siphon closure including an annular channel surrounding said valve seat in said annular body, and a stationary bell-shaped stopper secured in position in the liquid discharging channel in said valve body and having an upper part provided with a central opening adapted for guiding for axial movement said valve tube, and a lower part provided with a ring portion which projects into said annular channel of said siphon closure, said lower part having a plurality of vertically and radially directed slits forming a comb-like configuration.

2. A filling unit as defined in claim 1, wherein an upper surface of said lower part of said stopper is located approximately on the level of said valve seat and has a substantially cylindrical shape, and the upper part of said upper surface having an upwardly tapering shape.

3. A filling unit as defined in claim 1, wherein the central opening in said upper part of said stopper is provided with an axial groove for receiving and guiding a projection in said valve tube.

4. A filling unit as defined in claim 1, wherein the central opening in the lower part of said stopper has an increased diameter with respect to the upper part to define a stop surface for limiting the upward movement of said valve tube.

5. A filling unit as defined in claim 1, wherein said bell-shaped stopper is held in position in said liquid discharging channel by radially projecting arms.

* * * * *